US010535968B2

(12) United States Patent
Stevens et al.

(10) Patent No.: US 10,535,968 B2
(45) Date of Patent: Jan. 14, 2020

(54) FRAME ASSEMBLY FOR COAXIAL CABLE CONNECTORS

(71) Applicant: JOHN MEZZALINGUA ASSOCIATES, LLC, Liverpool, NY (US)

(72) Inventors: Brandon M. Stevens, Liverpool, NY (US); Christopher P. Natoli, Baldwinsville, NY (US)

(73) Assignee: JOHN MEZZALINGUA ASSOCIATES, LLC, Liverpool, NY (US)

( * ) Notice: Subject to any disclaimer, the term of this patent is extended or adjusted under 35 U.S.C. 154(b) by 0 days.

(21) Appl. No.: 16/320,788

(22) PCT Filed: Jul. 12, 2017

(86) PCT No.: PCT/US2017/041642

§ 371 (c)(1),
(2) Date: Jan. 25, 2019

(87) PCT Pub. No.: WO2018/022297

PCT Pub. Date: Feb. 1, 2018

(65) Prior Publication Data

US 2019/0341733 A1 Nov. 7, 2019

Related U.S. Application Data

(60) Provisional application No. 62/368,333, filed on Jul. 29, 2016.

(51) Int. Cl.
*H01B 13/20* (2006.01)
*H01R 43/027* (2006.01)
(Continued)

(52) U.S. Cl.
CPC ..... *H01R 43/027* (2013.01); *H01R 24/40* (2013.01); *H01R 2103/00* (2013.01)

(58) Field of Classification Search
CPC ..... H01R 43/027; H01R 43/0425; H01R 43/0486; H01R 9/0518; B25B 27/10
See application file for complete search history.

(56) References Cited

U.S. PATENT DOCUMENTS 5,138,864 A * 8/1992 Tarpill ..... H01R 43/042 29/751
5,274,903 A * 1/1994 Grois ..... G02B 6/3802 29/270

(Continued)

OTHER PUBLICATIONS

USPTO (ISA/US), International Search Report and Written Opinion from PCT/US2017/041642, Completed Aug. 30, 2017 (dated Sep. 13, 2017).

(Continued)

*Primary Examiner* — Paul D Kim
(74) *Attorney, Agent, or Firm* — Barclay Damon LLP

(57) ABSTRACT

A frame assembly for a compression tool, including a fitting configured to mount to the compression tool and receive a ram member thereof through a bore of the fitting; and a pair of interlocking jaws pivotally mounted to the fitting about a pair of non-coincident axes. The interlocking jaws are configured to at least partially envelop an annular compression ring while aligning the conductors of a coaxial cable with an axis of the cable connector. The ram member of the compression tool is activated to translate axially along the axis of the cable connector thereby mitigating misalignment of the compression ring as the ring engages the connector body.

20 Claims, 14 Drawing Sheets

(51) Int. Cl.
*H01R 103/00* (2006.01)
*H01R 24/40* (2011.01)

(56) References Cited

U.S. PATENT DOCUMENTS

| | | | | |
|---|---|---|---|---|
| 5,402,566 | A * | 4/1995 | Long | H01R 9/0518 174/880 |
| 6,574,855 | B1 * | 6/2003 | Hida | H01R 24/46 29/592.1 |
| 7,607,218 | B2 | 10/2009 | Montena | |
| 7,614,139 | B2 | 11/2009 | Trich | |
| 7,908,741 | B2 | 3/2011 | Chawgo | |
| 8,307,544 | B2 | 11/2012 | Natoli et al. | |
| 2006/0179647 | A1 * | 8/2006 | Montena | H01R 9/0518 29/751 |
| 2007/0251085 | A1 * | 11/2007 | Holliday | B21D 39/048 29/751 |
| 2008/0102696 | A1 * | 5/2008 | Montena | H01R 9/05 439/578 |
| 2016/0301173 | A1 | 10/2016 | Chawgo | |

OTHER PUBLICATIONS

International Bureau (ISA/US), International Preliminary Report on Patentability; International Application No. PCT/US2017/041642, Filed: Jul. 12, 2017; dated Jan. 29, 2019 5 pages.

* cited by examiner

FRAME ASSEMBLY FOR COAXIAL CABLE CONNECTORS

CROSS-REFERENCE TO RELATED APPLICATIONS

This application claims the benefit of the filing date and priority of U.S. Provisional Patent Application No. 62/368,333, filed on Jul. 29, 2016. The complete specification of such application is hereby incorporated by reference in its entirety.

BACKGROUND

Coaxial cable is a typical transmission medium used in communications networks, such as a CATV network. The cables which make up the transmission portion of the network are typically of the "hard-line" variety, while those used to distribute the signals into residences and businesses are typically "drop-line" connectors. A principal difference between hard-line and drop-line cables, apart from the size of the cables, e.g., the diameter of the cable, relates to the stiffness or rigidity of the cable. That is, hard-line cables include a rigid or semi-rigid outer conductor that prevents radiation leakage and protects the inner conductor and surrounding dielectric core. Drop connectors include a relatively flexible outer conductor, typically braided, that facilitates bending around obstacles, i.e., between the transition/junction box and the device to which the signal is carried, i.e., a television, computer, and the like. Hard-line cables generally span considerable distances along relatively straight paths, thereby eliminating the need for cable flexibility. As a consequence of these structural and functional differences, there are significantly different technical considerations involved in the design of the connectors used in conjunction with such coaxial cables.

When constructing and maintaining a network, such as a CATV network, the transmission cables are often interconnected to electrical equipment that "conditions" the signal being transmitted. The electrical equipment may be housed in a box that is located outside on a pole, or the like, or disposed underground, i.e., accessible by means of a cover. In either circumstance, the boxes have standard ports to which the transmission cables are connected. In order to maintain the electrical integrity of the signal, it is critical that the transmission cable be securely interconnected to the port without disrupting the ground connection of the cable. This, a paramount technical consideration, requires a skilled technician to effect a proper/reliable interconnection.

Currently, when employing a standard three-piece connector, it is difficult to secure the various components, i.e., the installer must hold the cable and connector firmly in position while tightening the coupling and body portions together, i.e., by manipulating a pair of wrenches. In another embodiment, an installer may use a compression gun to forcibly ram a compression ring over an end of the connector body. The plunger of the compression gun must be axially biased to hold the component parts together during actuation of the gun. Further, the compression ring and connector body must be precisely aligned, i.e., along the axis of the ram, to ensure uniform compaction of the connector body for the purpose of producing a viable electrical and mechanical connection therebetween. Generally, the various components must be axially biased within a frameset, or frame assembly, to guide the compression ring over the connector body. Should there be even a modicum of misalignment, i.e., between the compression ring and the connector axis, the electrical performance may be unacceptable. Finally, as the connector size varies, so too will it become necessary to vary the size of the frameset. Consequently, it will be necessary for an installer to carry an inventory of dedicated framesets, i.e., a wide variety of framesets to address the variability in size.

Therefore, there is a need to overcome, or otherwise lessen the effects of, the disadvantages and shortcomings described above.

SUMMARY

A frame assembly is provided for a compression tool, including a fitting configured to mount to the compression tool and receive a ram member thereof through a bore of the fitting; and a pair of interlocking jaws pivotally mounted to the fitting about a pair of non-coincident axes. The interlocking jaws are configured to at least partially envelop an annular compression ring while aligning the conductors of a coaxial cable with an axis of the cable connector. The ram member of the compression tool is activated to translate axially along the axis of the cable connector thereby mitigating misalignment of the compression ring as the ring engages the connector body.

In another embodiment, a pair of elongate arm members are pivotally mounted to the tool fitting about non-coincident axes. The arm members are spaced-apart to allow an axis of the ram to pass between the pair of elongate arm members. Furthermore, a pair of interlocking shoes are disposed in combination with the pair of elongate arm members and are configured to: (i) at least partially envelop and cradle a connector in preparation for being secured to a prepared end of a coaxial cable, (ii) receive an annular compression ring between the shoes in preparation for axial displacement over an end of the connector body, and (iii) form a quick-connect/disconnect interlock in response to pivot motion of the elongate arm members about the non-coincident axes.

In yet another embodiment, a method is disclosed for securing a coaxial cable to a cable connector. The method comprises the steps of: preparing the end of a coaxial cable to expose the inner and outer conductors of the coaxial cable; sliding a compression ring over the prepared end of the coaxial cable, inserting the prepared end of the coaxial cable into the cable connector and placing the cable connector into a cradle of a frame assembly. The frame assembly has a pair of elongate arms pivot mounted to a tool fitting about a pair of non-coincident axes. The tool fitting has a bore for receiving a ram member of the compression tool, and a pair of interlocking shoes are disposed in combination with the pair of elongate arms. The interlocking shoes mount to the elongate arms and are configured to at least partially envelop the annular compression ring of the connector while aligning the inner and outer conductors of the coaxial cable. In a final step, the compression tool is activated to forcibly urge the compression ring over an end of the cable connector, thereby securing the cable to the connector.

Additional features and advantages of the present disclosure are described in, and will be apparent from, the following Brief Description of the Drawings and Detailed Description.

BRIEF DESCRIPTION OF THE DRAWINGS

Additional features and advantages of the present disclosure are described in, and will be apparent from, the following Brief Description of the Drawings and Detailed Description.

DETAILED DESCRIPTION

Overview—Wireless Communication Networks

In one embodiment, wireless communications are operable based on a network switching subsystem ("NSS"). The NSS includes a circuit-switched core network for circuit-switched phone connections. The NSS also includes a general packet radio service architecture which enables mobile networks, such as 2G, 3G and 4G mobile networks, to transmit Internet Protocol ("IP") packets to external networks such as the Internet. The general packet radio service architecture enables mobile phones to have access to services such as Wireless Application Protocol ("WAP"), Multimedia Messaging Service ("MSS") and the Internet.

A service provider or carrier operates a plurality of centralized mobile telephone switching offices ("MTSOs"). Each MTSO controls the base stations within a select region or cell surrounding the MTSO. The MTSOs also handle connections to the Internet and phone connections.

Figure 1:
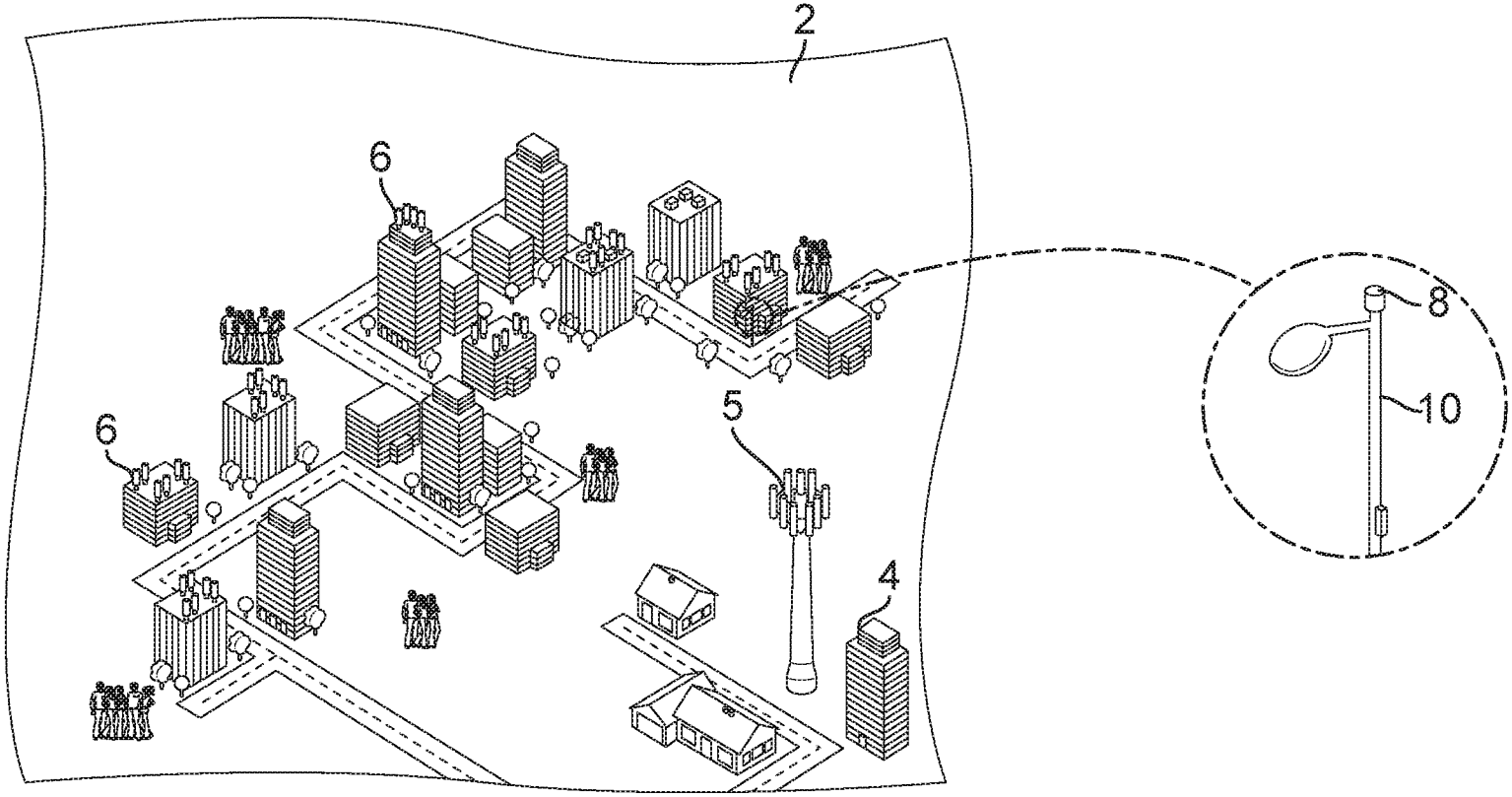
FIG. 1 is a schematic diagram illustrating an example of one embodiment of an outdoor wireless communication network.

Referring to FIG. 1, an outdoor wireless communication network 2 includes a cell site or cellular base station 4. The base station 4, in conjunction with cellular tower 5, serves communication devices, such as mobile phones, in a defined area surrounding the base station 4. The cellular tower 5 also communicates with macro antennas 6 on building tops as well as micro antennas 8 mounted to, for example, street lamps 10.

The cell size depends upon the type of wireless network. For example, a macro cell can have a base station antenna installed on a tower or a building above the average rooftop level, such as the macro antennas 5 and 6. A micro cell can have an antenna installed at a height below the average rooftop level, often suitable for urban environments, such as the street lamp-mounted micro antenna 8. A picocell is a relatively small cell often suitable for indoor use.

Figure 2:
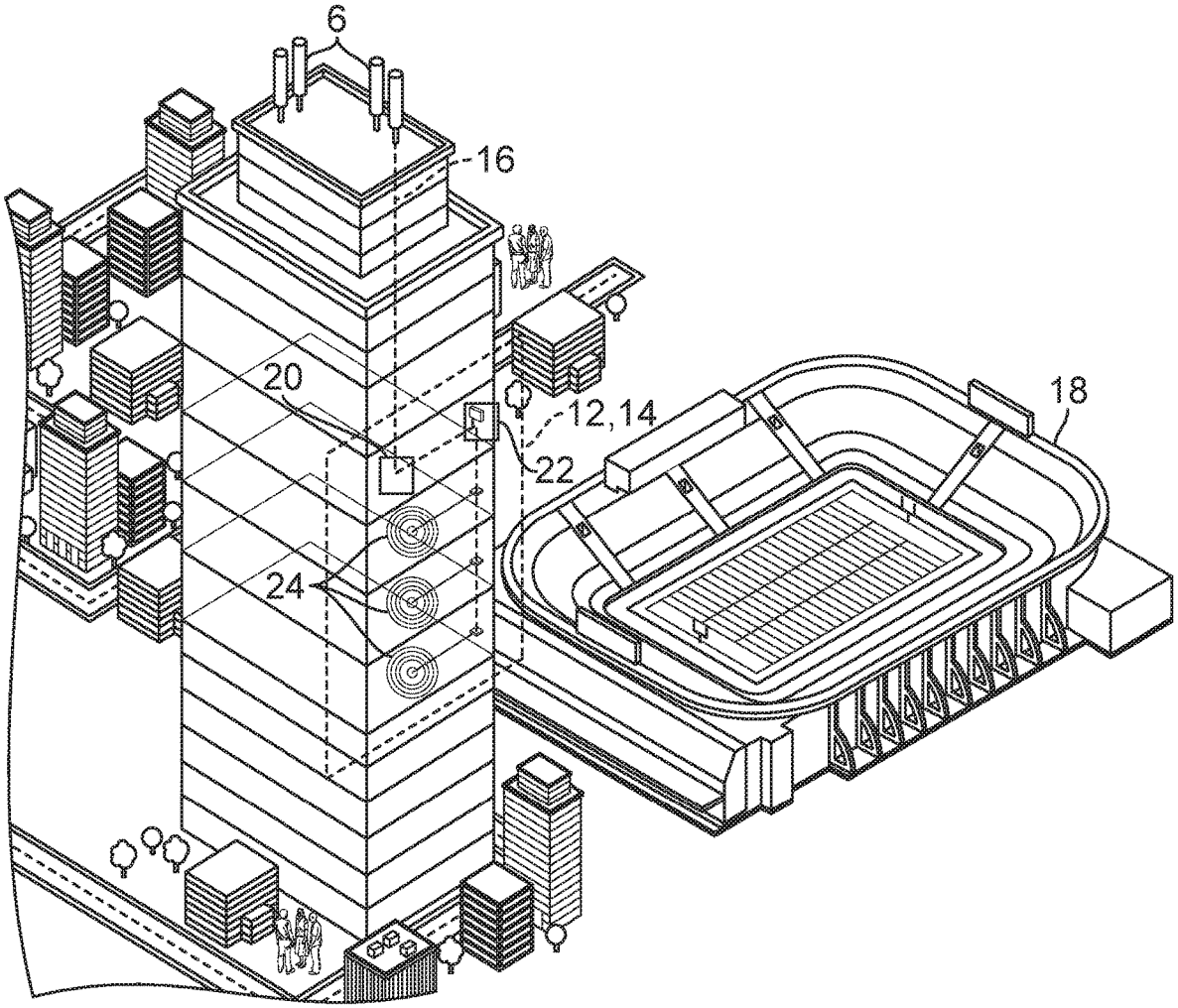
FIG. 2 is a schematic diagram illustrating an example of one embodiment of an indoor wireless communication network.

As illustrated in FIG. 2, an indoor wireless communication network 12 includes an active distributed antenna system ("DAS") 14. The DAS 14 can, for example, be installed in a high rise commercial office building 16, a sports stadium 8 or a shopping mall. In one embodiment, the DAS 14 includes macro antennas 6 coupled to a radio frequency ("RF") repeater 20. The macro antennas 6 receive signals from a nearby base station. The RF repeater 20 amplifies and repeats the received signals. The RF repeater 20 is coupled to a DAS master unit 22 which, in turn, is coupled to a plurality of remote antenna units 24 distributed throughout the building 16. Depending upon the embodiment, the DAS master unit 22 can manage over one hundred remote antenna units 24 in a building. In operation, the master unit 22, as programmed and controlled by a DAS manager, is operable to control and manage the coverage and performance of the remote antenna units 24 based on the number of repeated signals fed by the repeater 20. It should be appreciated that a technician can remotely control the master unit 22 through a Local Area Network (LAN) connection or wireless modem.

Depending upon the embodiment, the RF repeater 20 can be an analog repeater that amplifies all received signals, or the RF repeater 20 can be a digital repeater. In one embodiment, the digital repeater includes a processor and a memory device or data storage device. The data storage device stores logic in the form of computer-readable instructions. The processor executes the logic to filter or clean the received signals before repeating the signals. In one embodiment, the digital repeater does not need to receive signals from an external antenna, but rather, has a built-in antenna located within its housing.

Base Stations

Figure 3:
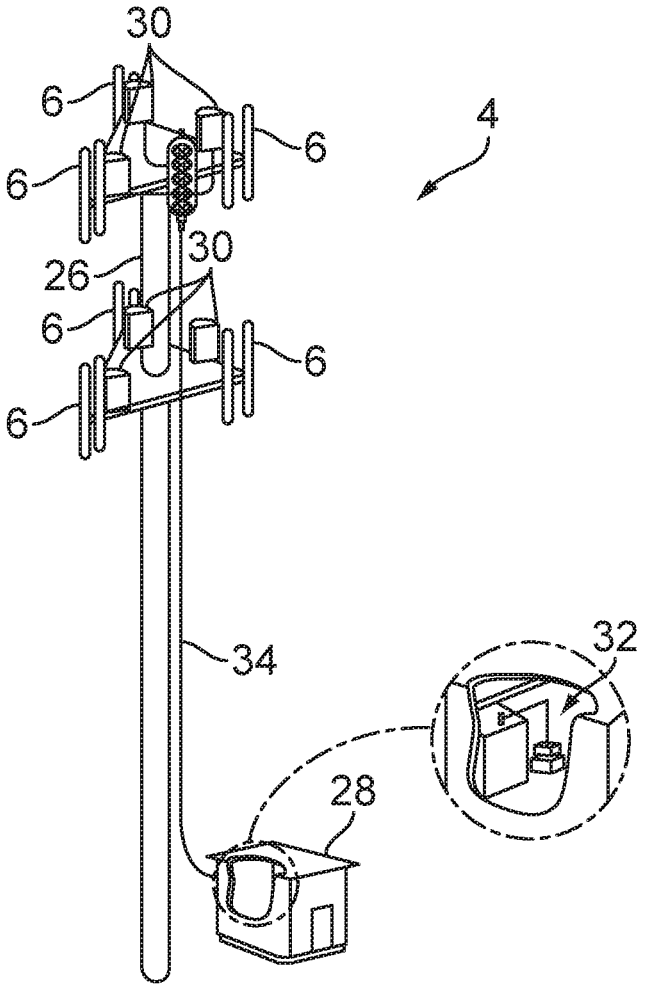
FIG. 3 is an isometric view of one embodiment of a base station illustrating a tower and ground shelter.

In one embodiment illustrated in FIG. 3, the base station 4 includes a tower 26 and a ground shelter 28 proximal to the tower 26. In this example, a plurality of exterior antennas 6 and remote radio heads 30 are mounted to the tower 26. The shelter 28 encloses base station equipment 32. Depending upon the embodiment, the base station equipment 32 includes electrical hardware operable to transmit and receive radio signals and to encrypt and decrypt communications with the MTSO. The base station equipment 32 also includes power supply units and equipment for powering and controlling the antennas and other devices mounted to the tower 26.

In one embodiment, a distribution line 34, such as coaxial cable or fiber optic cable, distributes signals that are exchanged between the base station equipment 32 and the remote radio heads 30. Each remote radio head 30 is operatively coupled, and mounted adjacent, a group of associated macro antennas 6. Each remote radio head 30 manages the distribution of signals between its associated macro antennas 6 and the base station equipment 30. In one embodiment, the remote radio heads 30 extend the coverage and efficiency of the macro antennas 6. The remote radio heads 30, in one embodiment, have RF circuitry, analog-to-digital/digital-to-analog converters and up/down converters.

Antennas

The antennas, such as macro antennas 6, micro antennas 8 and remote antenna units 24, are operable to receive signals from communication devices and send signals to the communication devices. Depending upon the embodiment, the antennas can be of different types, including, but not limited to, directional antennas, omni-directional antennas, isotropic antennas, dish-shaped antennas, and microwave antennas. Directional antennas can improve reception in higher traffic areas, along highways, and inside buildings like stadiums and arenas. Based upon applicable laws, a service provider may operate omni-directional cell tower signals up to a maximum power, such as 100 watts, while the service provider may operate directional cell tower signals up to a higher maximum of effective radiated power ("ERP"), such as 500 watts.

An omni-directional antenna is operable to radiate radio wave power uniformly in all directions in one plane. The radiation pattern can be similar to a doughnut shape where the antenna is at the center of the donut. The radial distance from the center represents the power radiated in that direction. The power radiated is maximum in horizontal directions, dropping to zero directly above and below the antenna.

An isotropic antenna is operable to radiate equal power in all directions and has a spherical radiation pattern. Omni-directional antennas, when properly mounted, can save energy in comparison to isotropic antennas. For example, since their radiation drops off with elevation angle, little radio energy is aimed into the sky or down toward the earth where it could be wasted. In contrast, isotropic antennas can waste such energy.

In one embodiment, the antenna has: (a) a transceiver moveably mounted to an antenna frame; (b) a transmitting data port, a receiving data port, or a transceiver data port; (c) an electrical unit having a PC board controller and motor; (d) a housing or enclosure that covers the electrical unit; and (e) a drive assembly or drive mechanism that couples the motor to the antenna frame. Depending upon the embodiment, the transceiver can be tiltably, pivotably or rotatably mounted to the antenna frame. One or more cables connect the antenna's electrical unit to the base station equipment 32 for providing electrical power and motor control signals to the antenna. A technician of a service provider can reposition the antenna by providing desired inputs using the base station equipment 32. For example, if the antenna has poor reception, the technician can enter tilt inputs to change the tilt angle of the antenna from the ground without having to climb up to reach the antenna. As a result, the antenna's motor drives the antenna frame to the specified position. Depending upon the embodiment, a technician can control the position of the moveable antenna from the base station, from a distant office or from a land vehicle by providing inputs over the Internet.

Data Interface Ports

Figure 4:
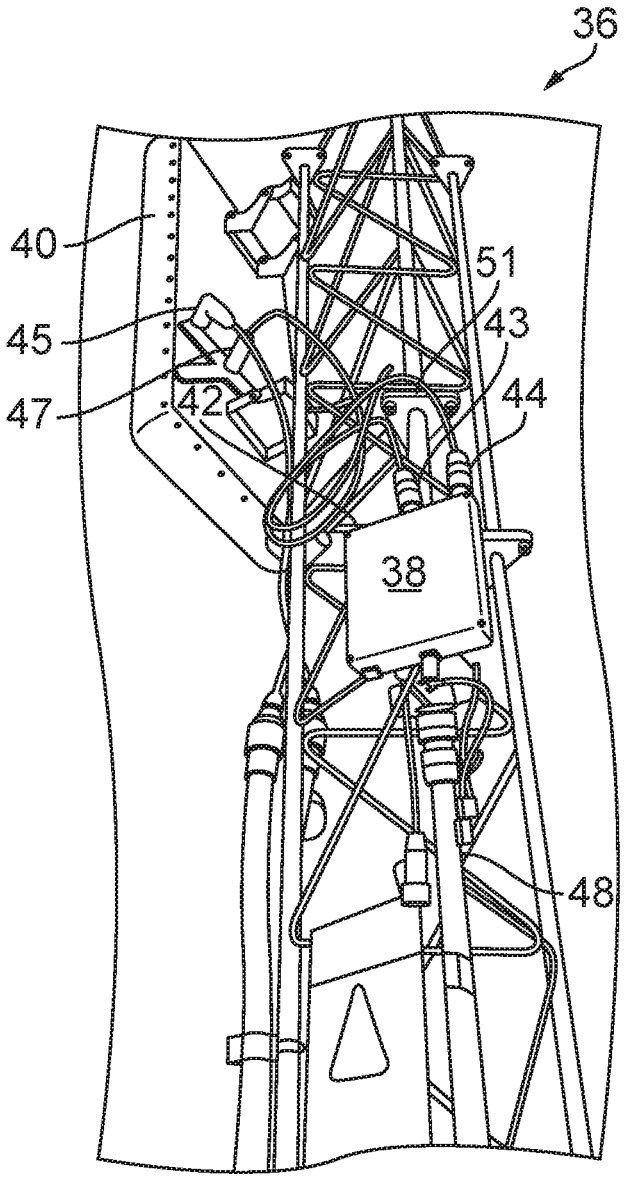
FIG. 4 is an isometric view of one embodiment of a tower.

Generally, the networks 2 and 12 include a plurality of wireless network devices, including, but not limited to, the base station equipment 32, one or more radio heads 30, macro antennas 6, micro antennas 8, RF repeaters 20 and remote antenna units 24. As described above, these network devices include data interface ports which couple to connectors of signal-carrying cables, such as coaxial cables and fiber optic cables. In the example illustrated in FIG. 4, the tower 36 supports a radio head 38 and macro antenna 40. The radio head 38 has interface ports 42, 43 and 44 and the macro antenna 40 has antenna ports 45 and 47. In the example shown, the coaxial cable 48 is connected to the radio head interface port 42, while the coaxial cable jumpers 50 and 51 are connected to radio head interface ports 44 and 45, respectively. The coaxial cable jumpers 50 and 51 are also connected to antenna interface ports 45 and 47, respectively.

Figure 5:
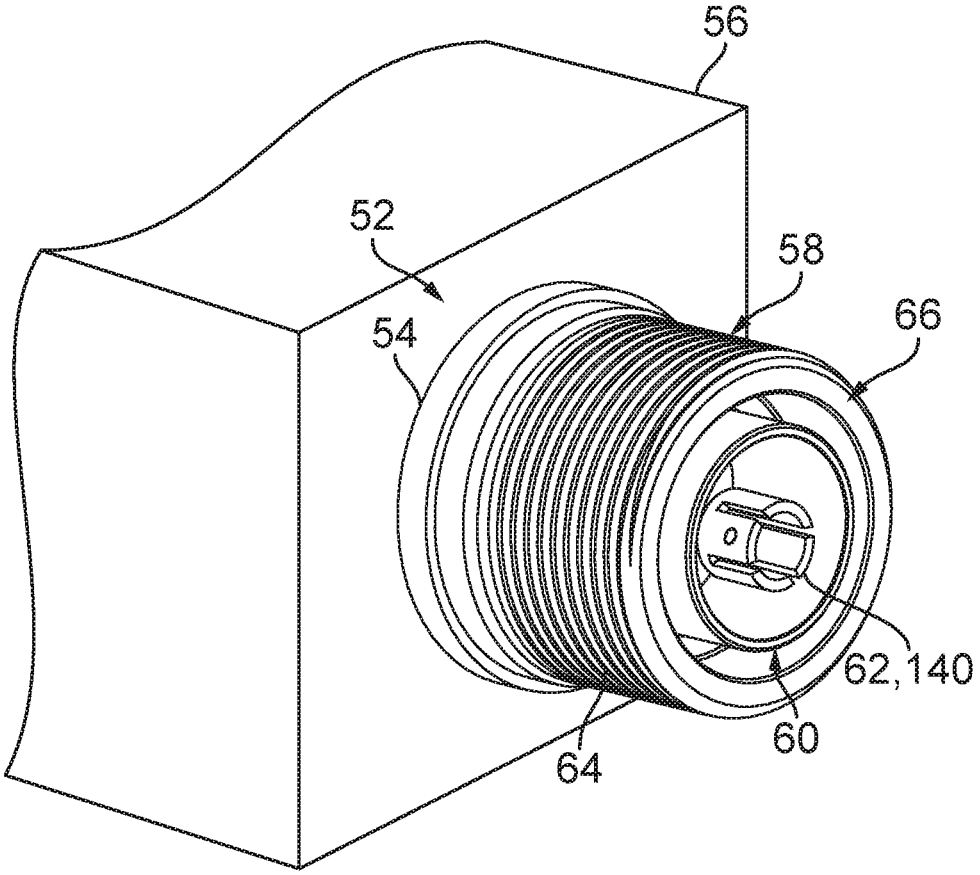
FIG. 5 is an isometric view of one embodiment of an interface port.

The interface ports of the networks 2 and 12 can have different shapes, sizes and surface types depending upon the embodiment. In one embodiment illustrated in FIG. 5, the interface port 52 has a tubular or cylindrical shape. The interface port 52 includes: (a) a forward end or base 54 configured to abut the network device enclosure, housing or wall 56 of a network device; (b) a coupler engager 58 configured to be engaged with a cable connector's coupler, such as a nut; (c) an electrical ground 60 received by the coupler engager 58; and (d) a signal carrier 62 received by the electrical grounder 60.

Figure 6:
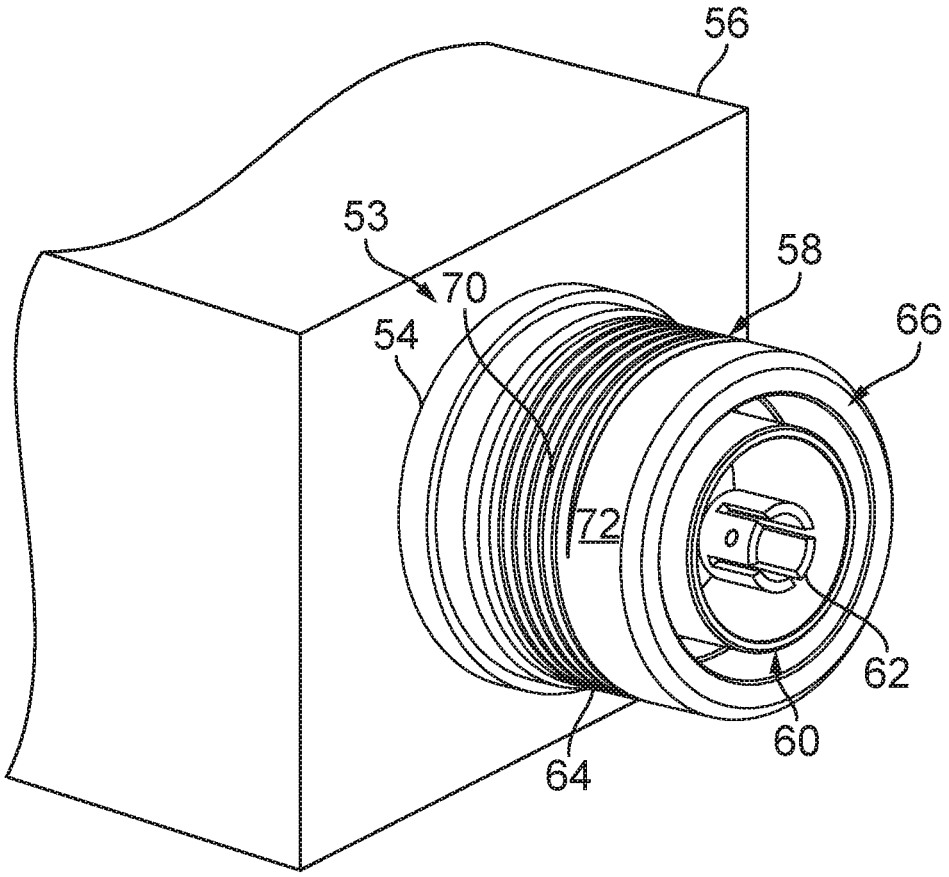
FIG. 6 is an isometric view of another embodiment of an interface port.
Figure 7:
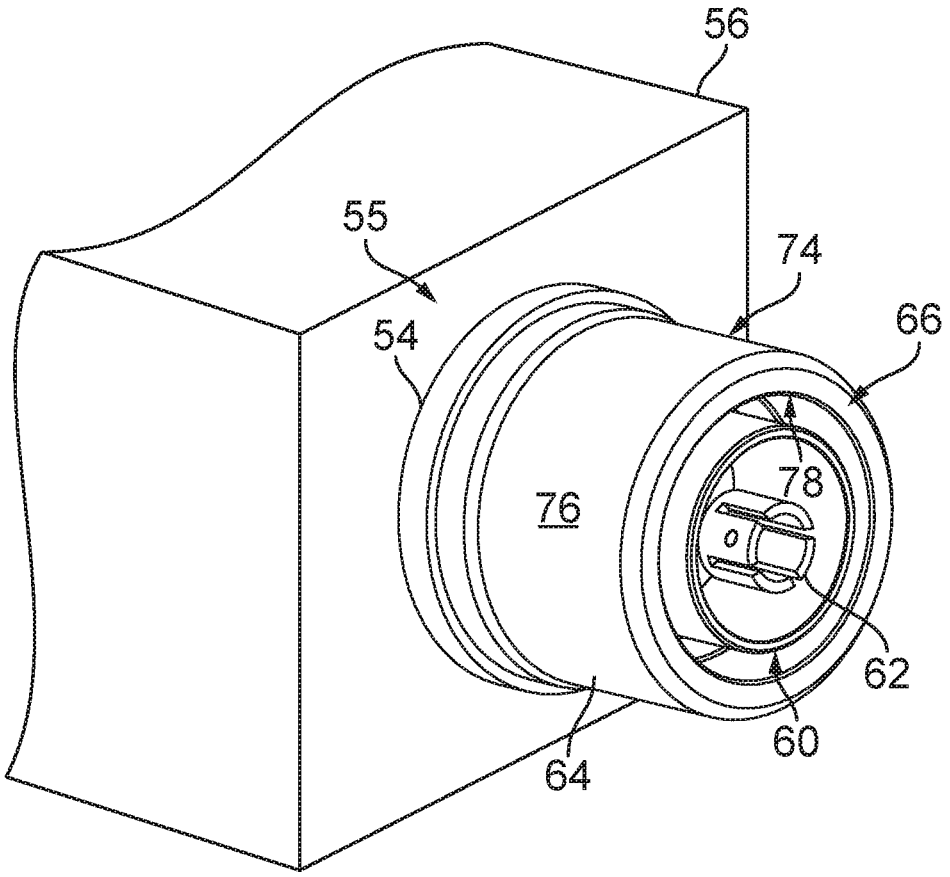
FIG. 7 is an isometric view of yet another embodiment of an interface port.

In the illustrated embodiment, the base 54 has a collar shape with a diameter larger than the diameter of the coupler engager 58. The coupler engager 58 is tubular in shape, has a threaded, outer surface 64 and a rearward end 66. The threaded outer surface 64 is configured to threadably mate with the threads of the coupler of a cable connector, such as connector 68 described below. In one embodiment illustrated in FIG. 6, the interface port 53 has a forward section 70 and a rearward section 72 of the coupler engager 58. The forward section 70 is threaded, and the rearward section 72 is non-threaded. In another embodiment illustrated in FIG. 7, the interface port 55 has a coupler engager 74. In this embodiment, the coupler engager 74 is the same as coupler engager 58 except that it has a non-threaded, outer surface 76 and a threaded, inner surface 78. The threaded, inner surface 78 is configured to be inserted into, and threadably engaged with, a cable connector.

Referring to FIGS. 5-8, in one embodiment, the signal carrier 62 is tubular and configured to receive a pin or inner conductor engager 80 of the cable connector 68. Depending upon the embodiment, the signal carrier 62 can have a plurality of fingers 82 which are spaced apart from each other about the perimeter of the signal carrier 80. When the cable inner conductor 84 is inserted into the signal carrier 80, the fingers 82 apply a radial, inward force to the inner conductor 84 to establish a physical and electrical connection with the inner conductor 84. The electrical connection enables data signals to be exchanged between the devices that are in communication with the interface port. In one embodiment, the electrical ground 60 is tubular and configured to mate with a connector ground 86 of the cable connector 68. The connector ground 86 extends an electrical ground path to the ground 64 as described below.

Cables

In one embodiment illustrated in FIGS. 4 and 8-10, the networks 2 and 12 include one or more types of coaxial cables 88. In the embodiment illustrated in FIG. 8, the coaxial cable 88 has: (a) a conductive, central wire, tube, strand or inner conductor 84 that extends along a longitudinal axis 92 in a forward direction F toward the interface port 56; (b) a cylindrical or tubular dielectric, or insulator 96 that receives and surrounds the inner conductor 84; (c) a conductive tube or outer conductor 98 that receives and surrounds the insulator 96; and (d) a sheath, sleeve or jacket 100 that receives and surrounds the outer conductor 98. In the illustrated embodiment, the outer conductor 98 is corrugated, having a spiral, exterior surface 102. The exterior surface 102 defines a plurality of peaks and valleys to facilitate flexing or bending of the cable 88 relative to the longitudinal axis 92.

Figure 8:
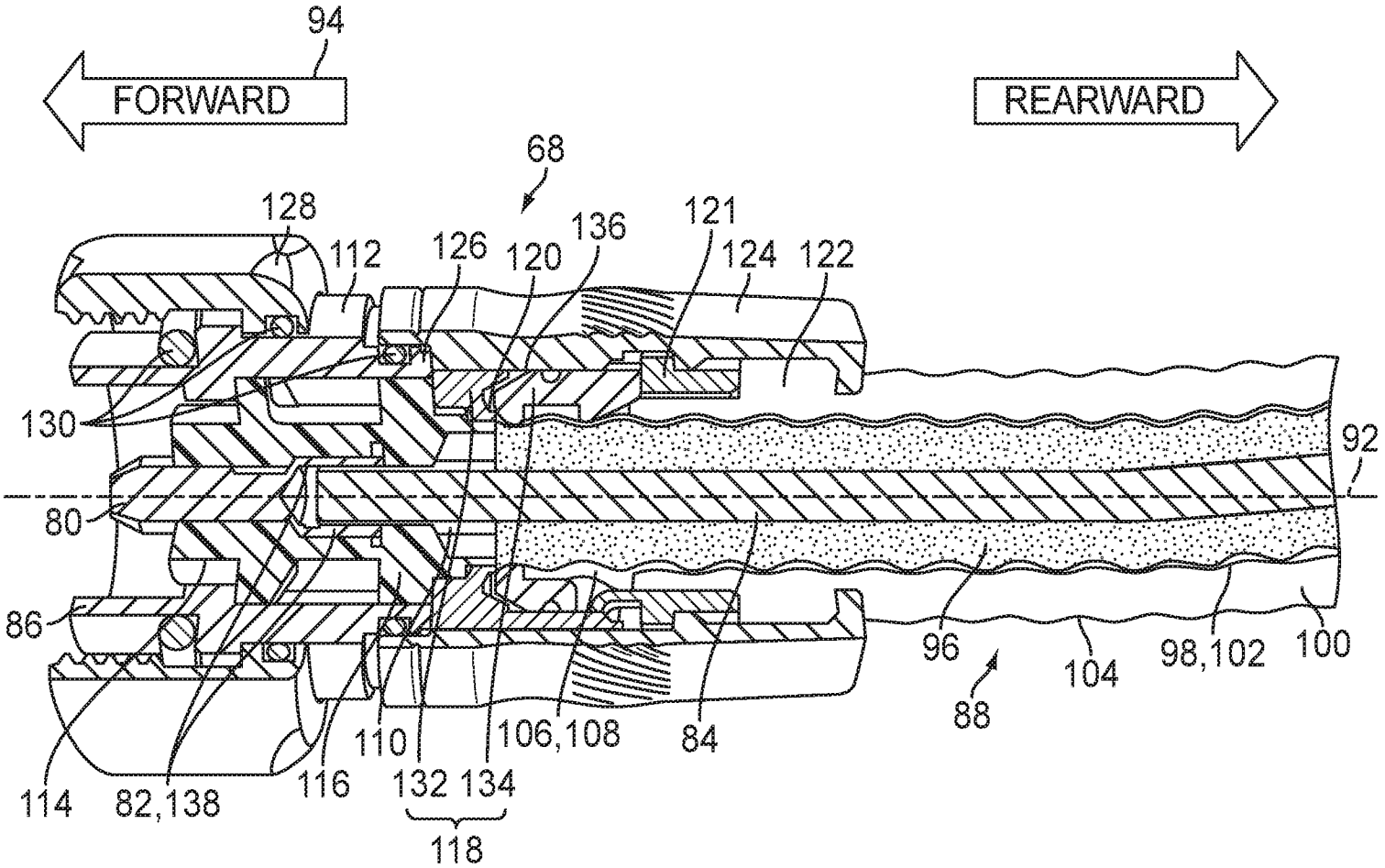
FIG. 8 is an isometric, cut-away view of one embodiment of a cable connector and cable.

To achieve the cable configuration shown in FIG. 8, an assembler/preparer, in one embodiment, takes one or more steps to prepare the cable 88 for attachment to the cable connector 68. In one example, the steps include: (a) removing a longitudinal section of the jacket 104 to expose the bare surface 106 of the outer conductor 108; (b) removing a longitudinal section of the outer conductor 108 and insulator 96 so that a protruding end 110 of the inner conductor 84 extends forward, beyond the recessed outer conductor 108 and the insulator 96, forming a step-shape at the end of the cable 68; (c) removing or coring-out a section of the recessed insulator 96 so that the forward-most end of the outer conductor 108 protrudes forward of the insulator 96.

In another embodiment not shown, the cables of the networks 2 and 12 include one or more types of fiber optic cables. Each fiber optic cable includes a group of elongated light signal guides or flexible tubes. Each tube is configured to distribute a light-based or optical data signal to the networks 2 and 12.

Materials

In one embodiment, the cable 88, connector 68 and interface ports 52, 53 and 55 have conductive components, such as the inner conductor 84, inner conductor engager 80, outer conductor 106, clamp assembly 118, connector body 112, coupler 128, ground 60 and the signal carrier 62. Such components are constructed of a conductive material suitable for electrical conductivity and, in the case of inner conductor 84 and inner conductor engager 80, data signal transmission. Depending upon the embodiment, such components can be constructed of a suitable metal or metal alloy including copper, but not limited to, copper-clad aluminum ("CCA"), copper-clad steel ("CCS") or silver-coated copper-clad steel ("SCCCS").

The flexible, compliant and deformable components, such as the jacket 104, environmental seals 122 and 130, and the cover 142 are, in one embodiment, constructed of a suitable, flexible material such as polyvinyl chloride (PVC), synthetic rubber, natural rubber or a silicon-based material. In one embodiment, the jacket 104 and cover 142 have a lead-free formulation including black-colored PVC and a sunlight resistant additive or sunlight resistant chemical structure. In one embodiment, the jacket 104 and cover 142 weatherize the cable 88 and connection interfaces by providing additional weather protective and durability enhancement characteristics. These characteristics enable the weatherized cable 88 to withstand degradation factors caused by outdoor exposure to weather.

Environmental Protection

Figure 9:
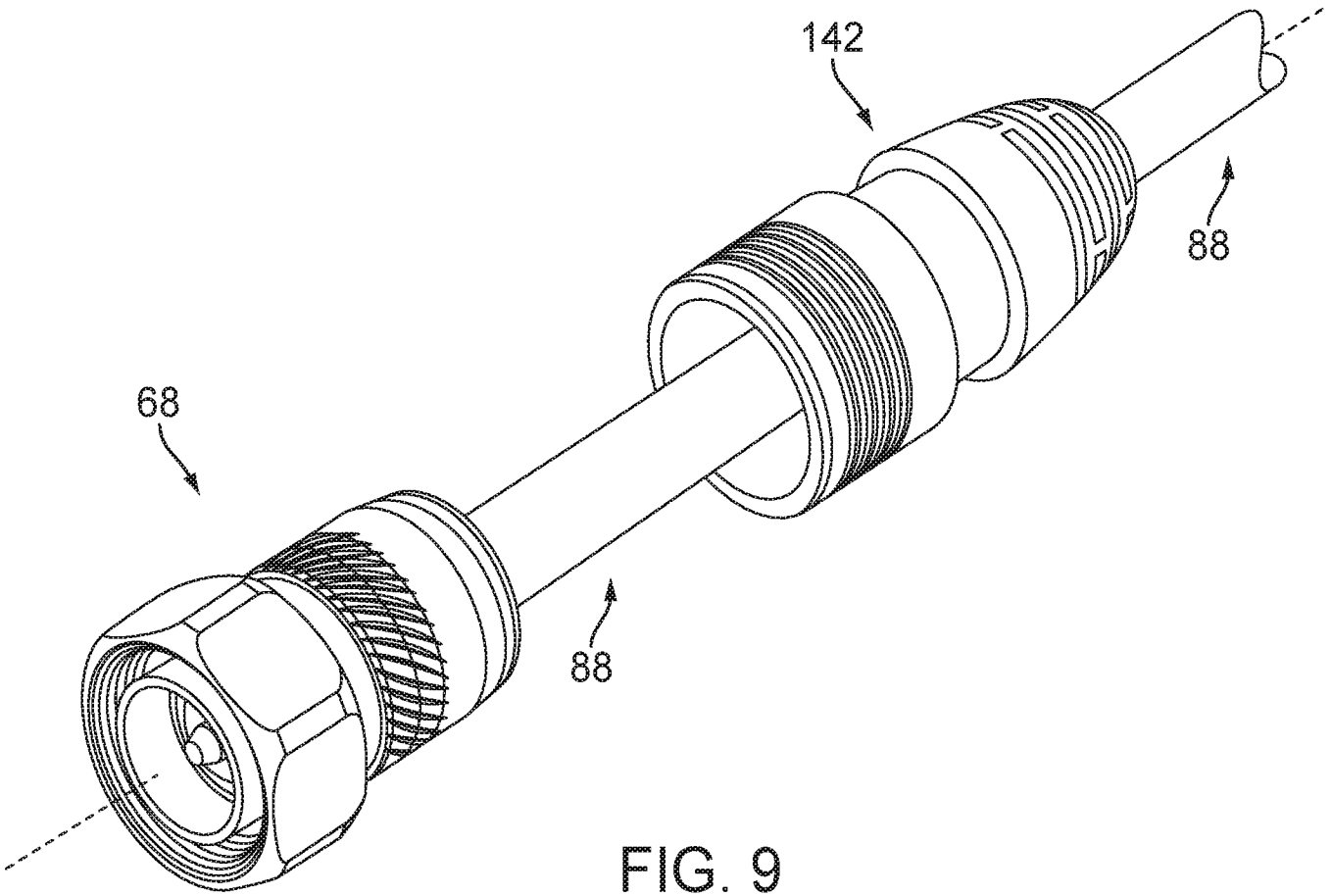
FIG. 9 is an isometric, exploded view of one embodiment of a cable assembly having a water resistant cover.
Figure 10:
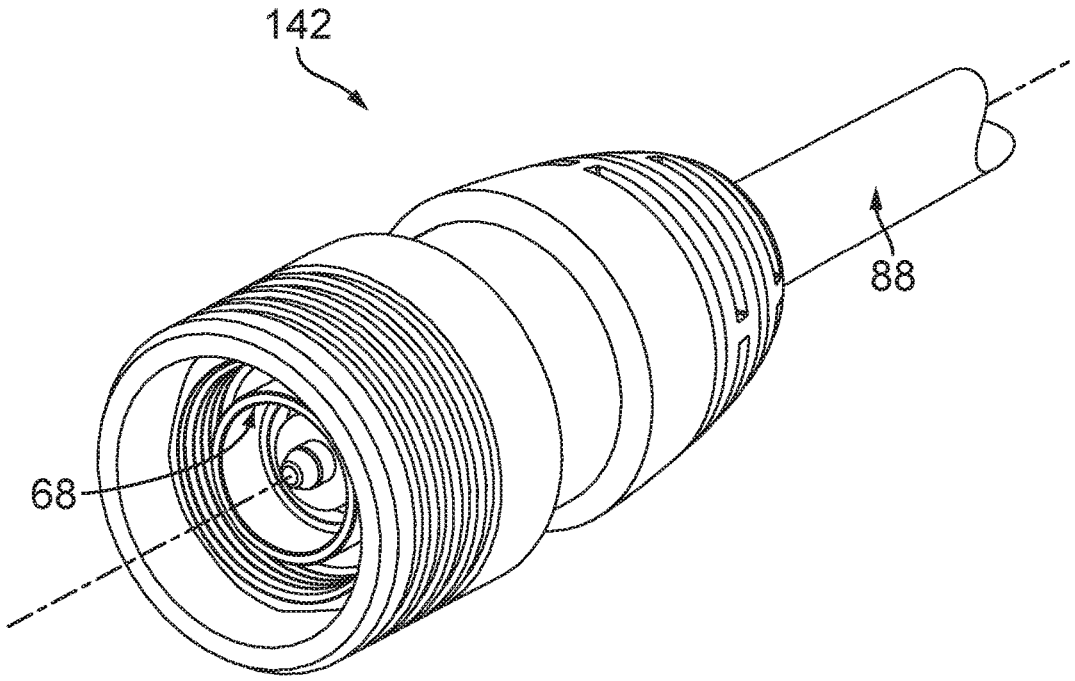
FIG. 10 is an isometric view of one embodiment of a cable connector enveloped by a water resistant cover.

In one embodiment, a protective boot or cover, such as the cover 142 illustrated in FIGS. 9-10, is configured to enclose part or all of the cable connector 88. In another embodiment, the cover 142 extends axially to cover the connector 68, the physical interface between the connector 68 and the interface port 52, and part or all of the interface port 52. The cover 142 provides an environmental seal to prevent the infiltration of environmental elements, such as rain, snow, ice, salt, dust, debris and air pressure, into the connector 68 and the interface port 52. Depending upon the embodiment, the cover 142 may have a suitable foldable, stretchable or flexible construction or characteristic. In one embodiment, the cover 142 may have a plurality of different inner diameters. Each diameter corresponds to a different diameter of the cable 88 or connector 68. As such, the inner surface of cover 142 conforms to, and physically engages, the outer surfaces of the cable 88 and the connector 68 to establish a tight environmental seal. The air-tight seal reduces cavities for the entry or accumulation of air, gas and environmental elements.

Frameset for Securing Connectors to Coaxial Cables

Notwithstanding the type of connector employed, nearly all connectors use axial displacement to effect radial compression of an annular ring or sleeve to trap a barbed end of a connector post between an outer conductor and dielectric core of a prepared coaxial cable. With respect to cable used in hard-line applications, the frictional and mechanical interlocking forces between the barbed end of the post, the compliant outer jacket of the cable and the compression ring secure the connector to the cable. When the cable used is for drop-line applications, the radial compression also effects an electrical connection, i.e., a grounding connection, between the braided outer conductor and the connector body. In both hard-line and drop-line applications, the axial displacement also causes the center conductor to be received within a multi-fingered socket of an extension rod or member to effect a signal-carrying electrical connection.

As mentioned in the background of the invention, it is common-practice to employ a hydraulic or pneumatic device to secure a cable connector to a coaxial cable. A typical hydraulic/pneumatic device useful for producing the necessary axial displacement and radial compression is described in commonly-owned, co-pending, U.S. patent application Ser. No. 15/188,494 entitled "Compression Tool with Biasing Member."

Figure 11:
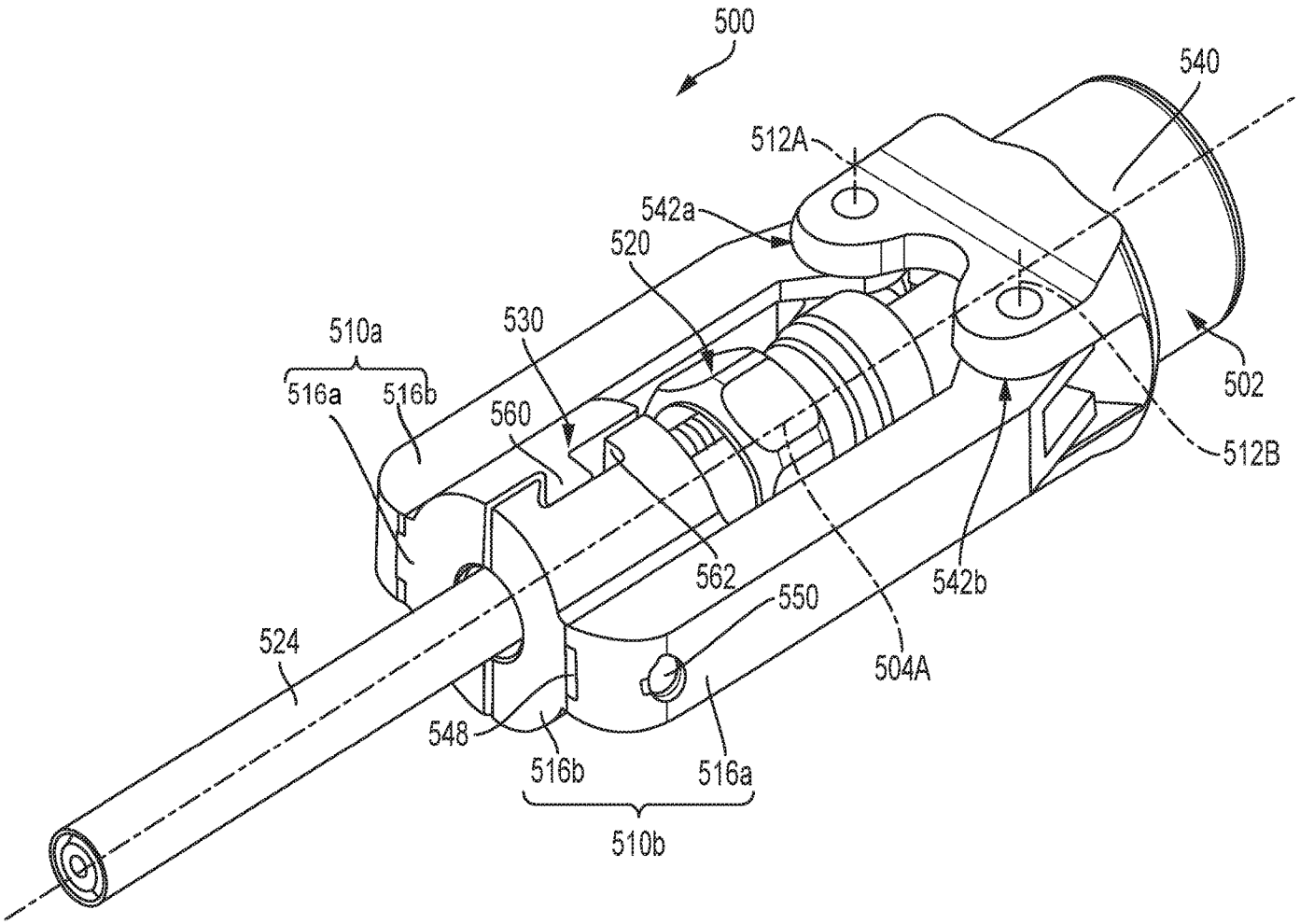
FIG. 11 is a perspective view of a frame assembly according to one embodiment of the disclosure wherein the frame assembly includes a tool fitting for engaging a compression gun, a pair of elongate arms which may be spread to accept a cable connector connected to a coaxial cable.

In a first embodiment of the invention and referring to FIG. 11, the aligning frameset, or frame assembly 500 includes a tool engager, coupling device, or tool fitting 502 configured to mount a hydraulic/pneumatic compression tool (not shown) and receive a plunger/ram 504 through a bore 506 of the tool fitting 502. Furthermore, the frame assembly 500 includes a pair of interlocking jaws 510*a*, 510*b* pivotally mounted to the tool fitting 502 about a pair of spaced-apart, non-coincident axes 512A, 512B. The interlocking jaws 510*a*, 510*b* are configured to, at least partially, envelop an annular compression ring and align the conductors of a coaxial cable 524 with an axis 504A of a cable connector 520 such that the plunger/ram 504 of the compression tool 500 translates axially along the axis of the cable connector 520. Axial translation of the plunger/ram 504 mitigates misalignment of the compression ring 526 when securing the connector 520 to the coaxial cable 524.

More specifically, the frame assembly 500 comprises: (i) a tool fitting 502 configured to mount a hydraulic/pneumatic compression tool (not shown) and receive the plunger/ram 504 through a bore 506 of the fitting 502; (ii) a pair of elongate arm members 508*a*, 508*b* pivotally mounted at one end to the tool fitting 502, each of the elongate arm members 508*a*, 508*b* pivoting about pivot axes 512A, 512B, which are non-coincident and spaced-apart to allow that the axis 504A of the plunger/ram 504 to bifurcate or pass between the pair of arm members 508*a*, 508*b*; and (iii) a pair of interlocking shoes 516*a*, 516*b*, disposed in combination with the elongate arm members 508*a*, 508*b*, i.e., one of the shoes 516*a* mounts to one of the elongate arm members 508*a*, 508*b* and the other of the shoes 516*b* mounts to the other of the elongate arm members 508*a*, 508*b*. The shoes 516*a*, 516*b* are configured to: (a) at least partially envelop and cradle a portion of the connector 520 in preparation for being secured to a prepared end 522 of a coaxial cable 524, (b) receive an annular compression ring 526 between the shoes 516*a*, 516*b* in preparation for axial displacement of the ring 526 over an end of the connector body 528, and (c) form a quick-connect/disconnect interlock 530 in response to pivot motion of the elongate arm members 508*a*, 508*b* about the non-coincident axes 512A, 512B.

With respect to the latter, the interlock 530 is configured to pivot about the non-coincident axes 512A, 512B to allow foreshortening of one arm member 508*a* relative to the other arm member 508*b* thereby enabling the shoes 516*a*, 516*b* to be joined and disconnected when the arm members 508*a*, 504*b* are pivoted to one side of the plunger/ram axis 504A. As will be understood when discussing subsequent views, the shoes 516*a*, 516*b* interlock when the elongate arms members 508*a*, 508*b* are parallel to the plunger/ram axis 504A.

In the described embodiment, the tool fitting 502 includes a connecting sleeve 540 which may be internally threaded for threadably engaging and externally threaded sleeve (not shown) of the compression tool. Furthermore, the sleeve 540 transitions to form a pair of clevis plates or fittings 542*a*, 542*b* each defining one of the non-coincident pivot axes 512A, 512B. In the described embodiment, the pivot axes 512A, 512B are spaced-apart and are disposed on each side of the plunger/ram axis 504A. Each of the elongate arms 508*a*, 508*b* is pivot mounted, at its base, to one of the clevis plates or fittings 542*a*, 542*b*. At the opposite end, each of the elongate arms 508*a*, 508*b* includes a rail 548 for accepting one of the interlocking shoes 516*a*, 516*b* and a set screw 550 for securing the respect one of the shoes 516*a*, 516*b*. In the described embodiment, each of the interlocking shoes 516*a*, 516*b* are detachable for accommodating cable connectors of varying size.

Figure 12:
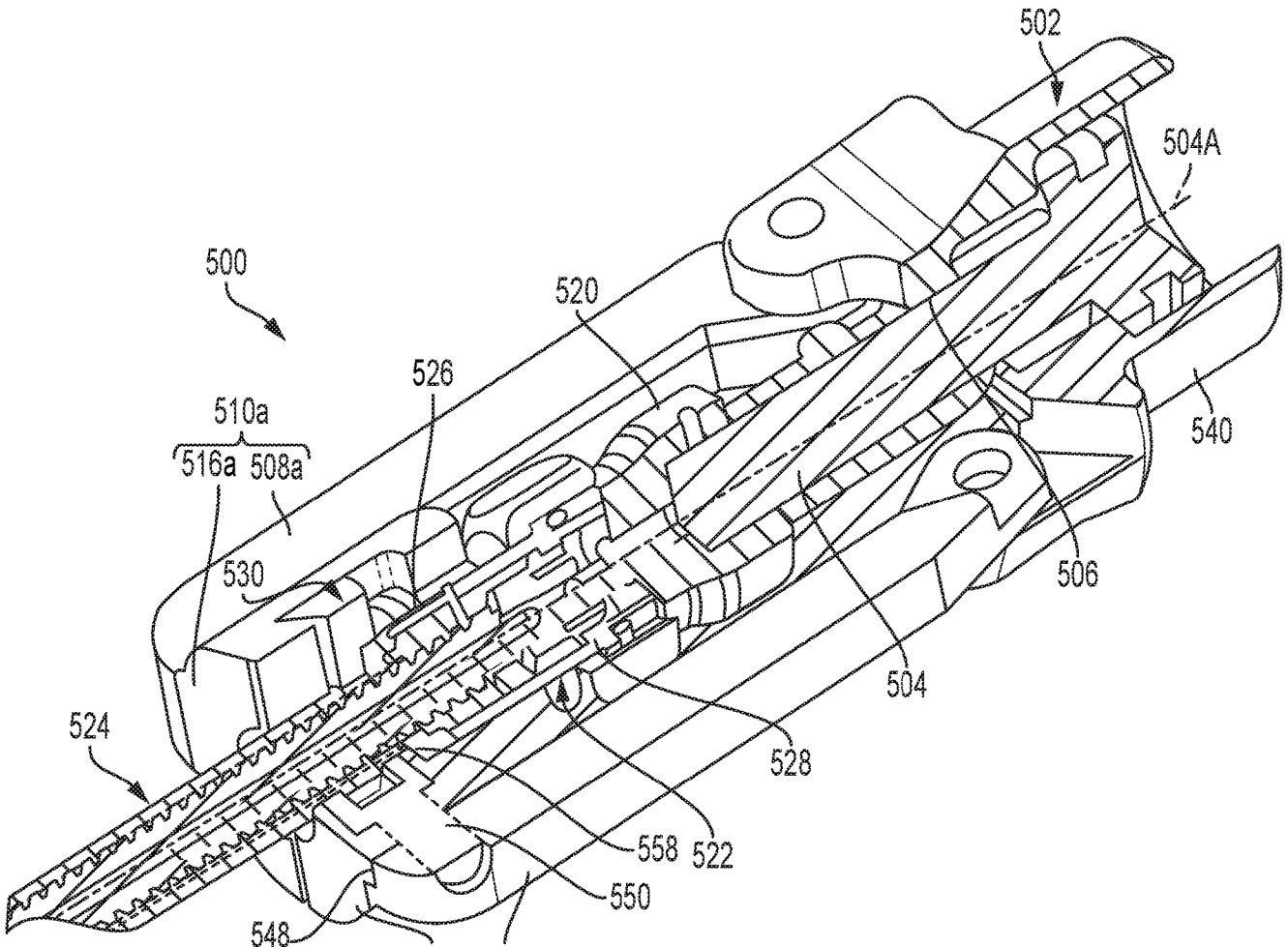
FIG. 12 is a perspective view of the frame assembly with a quarter-section removed to view the relevant internal details of the frame assembly including a tool fitting, the elongate arms and a pair of interlocking shoes.
Figure 13:
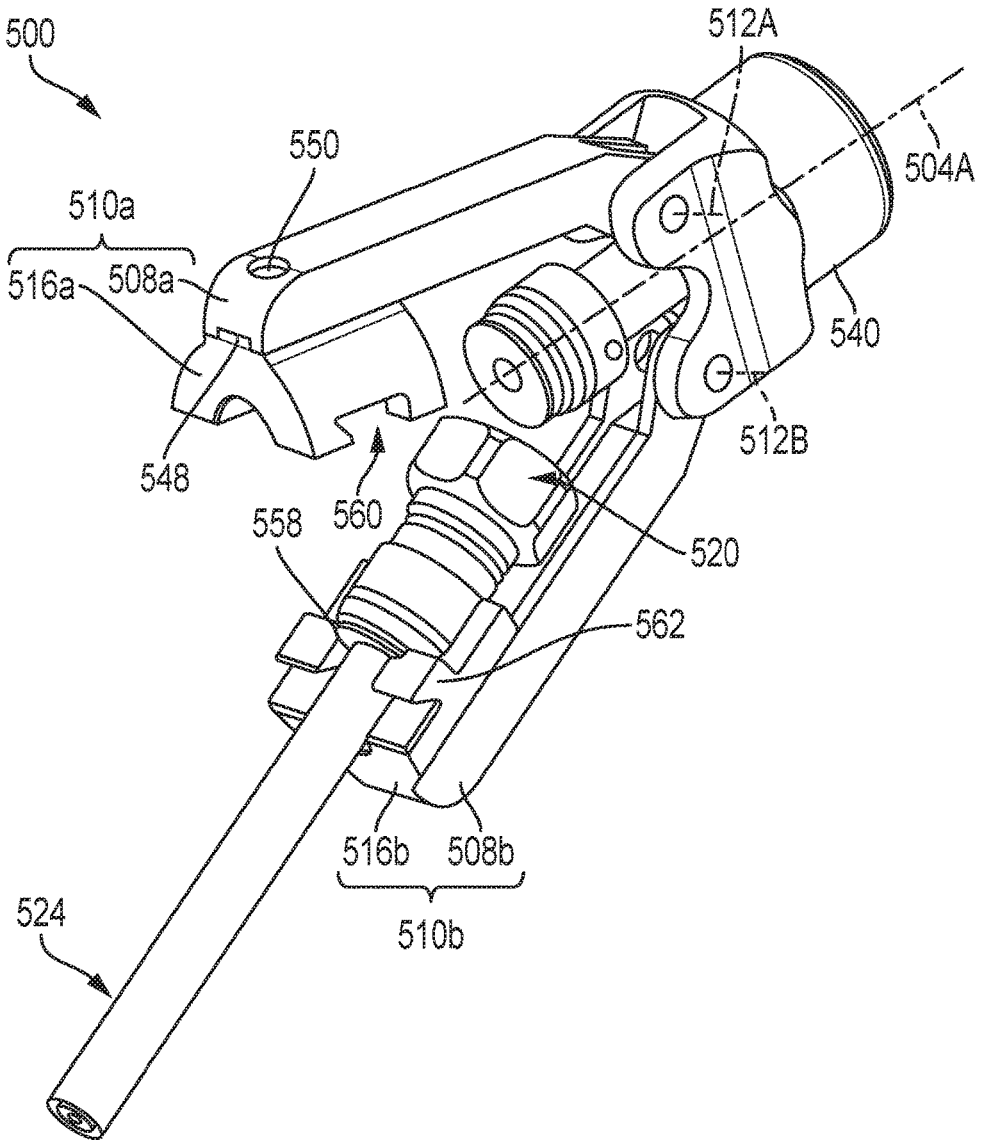
FIG. 13 depicts a perspective view of the frame assembly wherein the pair of elongate arms have been pivoted away from a central axis of the compression tool such that one of the interlocking shoes is disposed in combination with one of the elongate arms to receive a cable connector/coaxial cable.

In FIGS. 11, 12 and 13, at least one of the elongate arms 508*a*, 508*b* includes a torsional spring 554 operative to bias the respective one of the arms 508*a*, 508*b* toward the plunder/ram axis 504A and, in one embodiment, both of the arms 508*a*, 508*b* are torsionally biased inwardly. In the described embodiment, each of the elongate arms 508*a*, 508*b* may be spread outwardly such that each may pivot a threshold angle in each direction relative to the pivot axis 512A, 512B. At least one of the elongate arms 508*a*, 508*b* includes a pivot stop 546 which prevents the respective one of the arms 508*a*, 508*b* from pivoting outwardly, away from the plunger/ram axis 504A more than a predetermined angle relative to the axis 504A. Generally, one of the arms 508*a*, 508*b* may pivot through an arc of at least thirty degrees (30°) while the other of the arms 508*a*, 508*b* may pivot through an arc of at least sixty degrees (60°).

Each of the interlocking shoes 516*a*, 516*b* is generally C-shaped and forms a cradle-shaped shoulder 558 (best shown in FIG. 12) receiving at least a portion of the annular compression ring 526 of the cable connector 520. The interlock 530 may be formed in a face or opposing surface of each of the shoes 516*a*, 516*b*. In the described embodiment, a key-shaped recess 560 is formed in the face of one of the shoes 516*a*, 516*b* and a corresponding shaped catch or latch 562 is formed in the face of the other of the shoes 516*a*, 516*b*. While the embodiment shows a wedge-, polygonal, or trapezoidal-shaped recess, it will be appreciated that any of a variety of key-shaped recesses/catch structures may be employed to produce the quick-connect/disconnect interlock 530.

Operationally, a coaxial cable 524 is prepared to expose the inner and outer conductors of the coaxial cable, i.e., the insulating core is stripped back to expose the inner conductor and the compliant jacket is removed to expose the outer conductor. The compression ring is disposed over the prepared end of the coaxial cable and the prepared end is received into an end of the connector body.

Next, the tool fitting 502 of the frame assembly 500 is attached to a compression gun such that the plunger/ram 504 thereof projects through the bore 506 formed in the tool fitting 502.

Figure 14A:
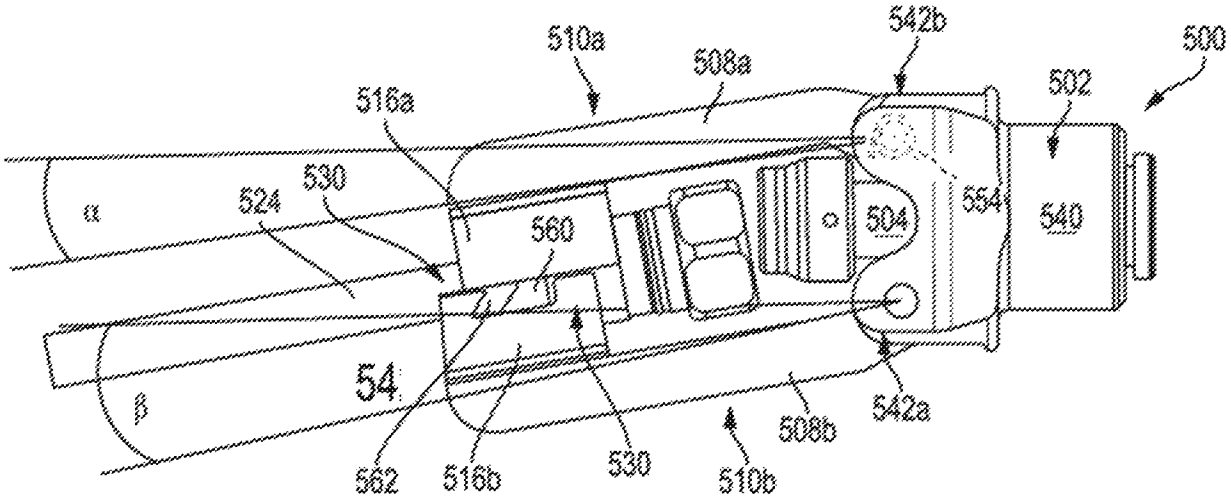
FIG. 14*a* depicts a plan view of the frame assembly wherein at least one of the elongate arms has been pivoted away from the axis of the ram member to effect foreshortening of the other elongate arm relative to an interlock recess formed one of the shoes such that an interlock key of the other shoe engages and locks with the interlock recess.
Figure 14B:
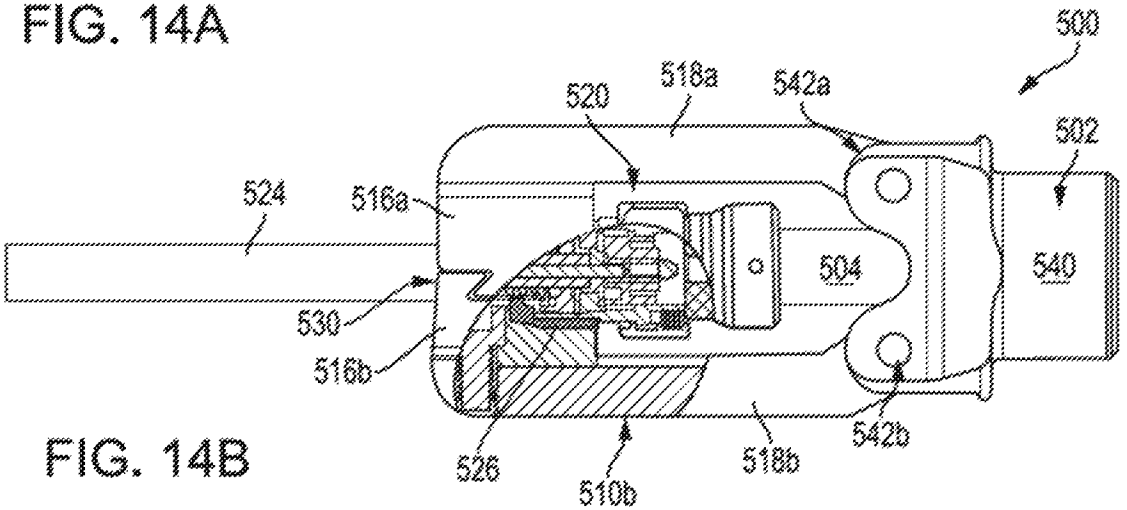
FIG. 14*b* depicts the same view of the frame assembly shown in FIG. 14*a* wherein the elongate arms have been pivoted back to a parallel orientation relative to the ram member while the interlocking shoes couple the frame assembly around the cable connector/coaxial cable.

In FIGS. 13, 14*a* and 14*b*, the elongate arms 508*a*, 508*b* are spread apart, in opposite directions (see FIG. 13), such that the cable connector 520 may be placed into the cradle-shaped shoulder 558 of the frame assembly 500. After opening the elongate arms 508*a*, 508*b*, the arms 508*a*, 508*b* are pivoted in the same direction, i.e., through threshold angles $\alpha$ & $\beta$ (see FIG. 14*a*), such that a foreshortening displacement of one of the shoes 516*a*, 516*b* relative to the other one of the shoes 516*a*, 516*b* causes the interlock key 560 to be received within the interlock catch 562.

Next, the elongate arms 508*a*, 508*b* are returned to an axial orientation as shown in FIG. 14*b*, i.e., parallel with the axis 504A of the plunger/ram 504, such that the interlock 530 engages the shoes 516*a*, 515*b* over the cable connector 520. This step also locks the shoes 516*a*, 516*b* together. In a final step, the compression gun is activated to displace the plunger/ram 504 and forcibly urge the compression ring 526 over an end of the cable connector 520. As a consequence, the compression ring 526 secures the coaxial cable to the cable connector 520.

The frame assembly 500 of the present disclosure provides a simple and elegant solution to an otherwise complex and labor intensive process, i.e., method of securing a coaxial cable to a cable connector. The frame assembly 500 may employ as few as four (4) component parts, i.e., a tool fitting 502, a pair of interlocking jaws 510*a*, 510*b* and at least one torsion spring 554. The torsion spring 554 allows the elongate arms 516*a*, 516*b* to remain aligned or parallel with the ram 504 once the interlocking shoes 516*a*, 516*b* have been coupled. It is important to note, that the shoes 516*a*, 516*b* may have a variety of shapes and sizes provided that each includes a complementary cradle structure or shoulder. While the described embodiment discloses a guide rail 558 and set screw 558 to facilitate reconfiguration of the frame assembly 500, the shoes 516*a*, 516*b* may employ any of a variety of quick-connection and quick-disconnecting apparatus including spring-loaded detents and/or spring-load pins to allow the rapid reconfiguration of the frame assembly 500.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A frame assembly for a compression tool, comprising:

a fitting configured for mounting to the compression tool and receiving a ram member of the compression tool through a bore of the fitting; and a pair of interlocking jaws pivotally mounted to the fitting about a pair of non-coincident axes, the interlocking jaws configured to at least partially envelop an annular compression ring while aligning the conductors of a coaxial cable with an axis of the cable connector such that the ram member translates axially along the axis of the cable connector to mitigate misalignment of the compression ring when securing the connector to the coaxial cable.

2. The frame assembly of claim 1 wherein the interlocking jaws is coupled when a pivot motion of the interlocking jaws exceeds a threshold angle.

3. The frame assembly of claim 1 further comprising at least one torsion spring disposed about at least one of the non-coincident pivot axes, and wherein the at least one torsion spring is operative to torsionally bias at least one of the interlocking jaws inwardly toward the connector axis.

4. The frame assembly of claim 1 wherein the pair of interlocking jaws includes:

a pair of elongate arms pivotally mounted to the fitting;

a first shoe mounted an end of one elongate arm;

a second shoe mounted to an end of the other elongate arm; and a quick connect/disconnect interlock disposed in the face surfaces of the first and second shoe.

5. The frame assembly according to claim 4 wherein the elongate arms are spaced-apart and disposed to each side of the connector axis.

6. The frame assembly according to claim 4 wherein each shoe is detachable from the respective elongate arm to accommodate connectors of varying size.

7. The frame assembly according to claim 4 wherein one of the first and second shoes includes an interlock recess and the other of the first and second shoes includes a fixed interlock catch.

8. The frame assembly according to claim 4 wherein the interlock includes a shaped recess and a catch shaped to fit within the recess to secure the shoes in a closed position.

9. The frame assembly according to claim 4 wherein the interlock is integral with the shoe and defines a trapezoidal-shaped catch for fitting into a shaped recess.

10. A frame assembly comprising:

a tool fitting configured to mount to a compression tool and receive a ram through a bore of the fitting;

a pair of elongate arm members pivotally mounted to the tool fitting, each of the elongate arm members pivoting about non-coincident axes and being spaced-apart from each other to allow that an axis of the ram to pass between the pair of elongate arm members; and a pair of interlocking shoes disposed in combination with the pair of elongate arm members, the shoes configured to: (i) at least partially envelop and cradle a connector in preparation for being secured to a prepared end of a coaxial cable, (ii) receive an annular compression ring between the shoes in preparation for axial displacement over an end of the connector body, and (iii) form a quick connect/disconnect interlock in response to pivot motion of the elongate arm members about the non-coincident axes.

11. The frame assembly of claim 10, wherein the interlock includes a fixed interlock recess defined within a face surface of one shoe and an interlock key projecting from a face of the other shoe.

12. The frame assembly of claim 10 wherein the key of one shoe of the pair of interlocking shoes is received within the recess of the other shoe of the pair of interlocking shoes as a consequence of a foreshortening displacement between the elongate arm members.

13. The frame assembly according to claim 10 wherein the elongate arms are spaced-apart and disposed about the connector axis.

14. The frame assembly according to claim 10 wherein each shoe is detachable from the respective elongate arm to accommodate connectors of varying size.

15. The frame assembly according to claim 10 wherein one shoe includes an interlock recess and the other shoe includes a fixed interlock catch.

16. The frame assembly according to claim 10 wherein the interlock includes a shaped recess and a catch shaped to fit the recess to secure the shoes in a closed position.

17. The frame assembly according to claim 10 wherein the interlock is integral with the shoe and defines a trapezoidal-shaped catch for fitting into a shaped recess.

18. A method for securing a coaxial cable to a cable connector, comprising the steps of:

preparing an end of a coaxial cable to expose an inner and outer conductor of the coaxial cable;

sliding a compression ring over the prepared end of the coaxial cable;

inserting the prepared end of the coaxial cable into the cable connector;

placing the cable connector into a cradle of a frame assembly;

the frame assembly having a pair of elongate arms pivot mounted to a tool fitting about a pair of non-coincident axes, the tool fitting having a bore for receiving a ram member of a compression tool, and a pair of interlocking shoes disposed in combination with the pair of elongate arms, the interlocking shoes configured to at least partially envelop the annular compression ring while aligning the inner and outer conductors of a coaxial cable with an axis of the cable connector such that the ram member translates axially along the axis of the cable connector; and activating the compression tool to forcibly urge the compression ring over an end of the cable connector, thereby securing the cable to the cable connector.

19. The method of claim 18 further comprising the step of:

pivoting the elongate arms a threshold angle away from the connector axis to allow a key of one of the interlocking shoes to engage a recess of the other interlocking shoe.

20. The method of claim 18 wherein at least one of the interlocking shoes is detachable for accommodating cable connectors of varying size.

* * * * *